United States Patent [19]

Durham

[11] 4,245,442

[45] Jan. 20, 1981

[54] REUSABLE INTERIOR WALL AND CEILING CONSTRUCTION SYSTEM FOR BUILDINGS

[76] Inventor: I. Milt Durham, 5065 Westheimer, Suite 840, Houston, Tex. 77056

[21] Appl. No.: 58,858

[22] Filed: Jul. 19, 1979

[51] Int. Cl.[3] ..... E04B 2/78

[52] U.S. Cl. ..... 52/122; 52/241; 52/DIG. 4

[58] Field of Search ..... 52/122, 238, 241, 242, 52/239, 481

[56] References Cited

U.S. PATENT DOCUMENTS

| | | | |
|---|---|---|---|
| 3,292,328 | 12/1966 | Lewis et al. | 52/238 |
| 3,696,569 | 10/1972 | Didry | 52/122 |
| 3,759,001 | 9/1973 | Judkins | 52/241 |

FOREIGN PATENT DOCUMENTS

| | | | |
|---|---|---|---|
| 244548 | 1/1966 | Austria | 52/241 |
| 2113862 | 7/1972 | Fed. Rep. of Germany | 52/241 |
| 2644559 | 7/1977 | Fed. Rep. of Germany | 52/241 |

*Primary Examiner*—John E. Murtagh
*Attorney, Agent, or Firm*—Pravel, Gambrell, Hewitt, Kirk, Kimball & Dodge

[57] ABSTRACT

An object of the present invention is to provide a reusable modular interior wall and ceiling construction system for buildings.

The system utilizes a modular wall panel unit formed by a rectangular frame having a peripheral surface forming a central recess and a pair of securing slots. Decorative panels are releasably held to the frame by magnetic means. An adjustable base supports the wall panels and provides hollow runs for concealing wiring for power and communication purposes. The panel slots and central recess provide for securing with adjacent panel units as well as providing a means for connecting the modular ceiling support members. The ceiling support members may also serve as ducting for heating and cooling as well as passageways for wiring.

5 Claims, 13 Drawing Figures

REUSABLE INTERIOR WALL AND CEILING CONSTRUCTION SYSTEM FOR BUILDINGS

DESCRIPTION

1. Technical Field

This invention relates to reusable interior wall and ceiling construction systems for buildings and particularly for buildings having a uniform interior grid system.

Reusable interior wall and ceiling systems which enable flexible rearrangement of building interior work areas to permit their most efficient use are known. Such systems are relatively inexpensive to relocate as the ceiling and wall components can be reused and need not be entirely replaced when repositioned.

2. Background Art

Most multi-story office buildings have their interior wall and ceiling system arranged on a uniform interior grid system. While this is extremely helpful in arranging the air ducting and lighting above the hanging ceiling, such interior wall and ceiling systems have not been fully reusable. A readily accepted wall system is to use steel or metal "studs" to which dry wall or sheetrock is secured by suitable means such as bolting and them "floated" which is a time consuming process. When it becomes desirable to change the location of the wall, it is more economical to destroy the existing wall and build an entirely new wall out of new "studs" and sheetrock rather than attempt to move the wall. Of course the requirement for new materials increases the cost of any wall relocation project, since the construction materials are not reusable. Such method also requires that wiring be run when the walls are partially complete which further increases construction time.

Most buildings employ a hanging or suspended ceiling which utilizes a modular grid of support members. Generally the modular grid members are disposed below the air ducting to shield it from view while both lighting fixtures and reusable ceiling panels are supported on the modular grid. The ceiling modular grid system is normally independent of the wall system with the ceiling merely suspended closely above the walls.

Reusable panel interior wall and ceiling systems are known. In general, they are extremely expensive initially and their appearance is frequently unattractive. Often in rearranging a working area a wall or ceiling modular unit is damaged and must be discarded at substantial cost. The interconnecting arrangements of the reusable system are often complex which requires a great deal of care and time during disassembly and reassembly. Despite such drawbacks, such reusable systems are desirable for the flexibility they provide in rearranging working areas for maximum efficiency. Such prior reusable interior wall and ceiling systems have also generally failed to provide for simplified revisions of the air ducting as well as the electrical and communication wiring during rearranging.

DISCLOSURE OF THE INVENTION

A modular interior wall and ceiling system that may be easily erected, disassembled when desired, and quickly erected again in a desired pattern. The wall panel units have a hollow frame to which decorative wall panels are removably secured to provide access for wiring and ducting with the panel units. The hollow frame forms a peripheral edge having a central recess and a pair of slots formed on either side of the recess which serves as a support and securing means for the panel unit and enables rapid assembly and disassembly of the system. The panel sections may be treated with a wide range of covering to provide any desired appearance. An adjustable panel support unit engages the floor and provides means for leveling the panel to compensate for variations and smoothness of the floor. Connecting members that mount in the slots on either side of the central recess formed on the peripheral edge are used for mounting with the floor engaging members as well as providing a means for connecting with the hanging modular ceiling. The slots also provide connecting means for securing the panel with adjacent panels or other modular structures for securing the panel in the desired location. Disposable trim strips are provided to shield the panel connecting system from view to provide a desired appearance.

BEST MODE FOR CARRYING OUT THE INVENTION

Figure 1:
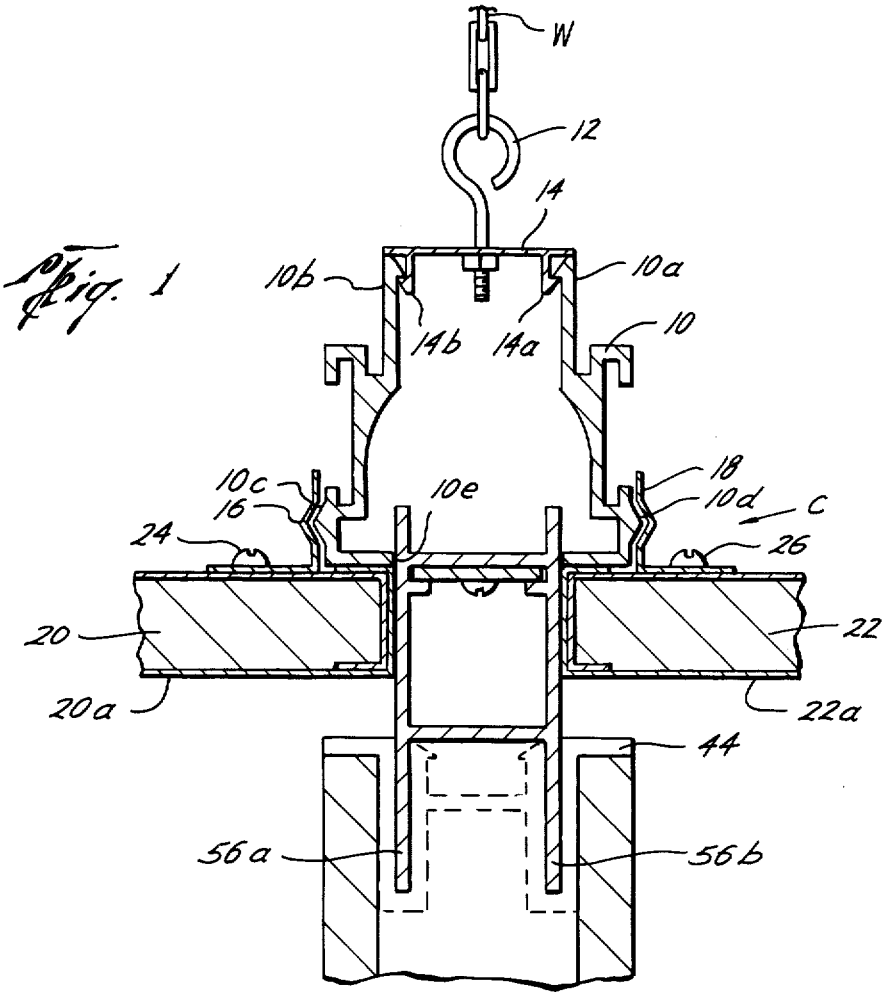
FIG. 1 is a side view, in section, of the upper portion of the modular wall panel unit apparatus of the present invention.
Figure 2:
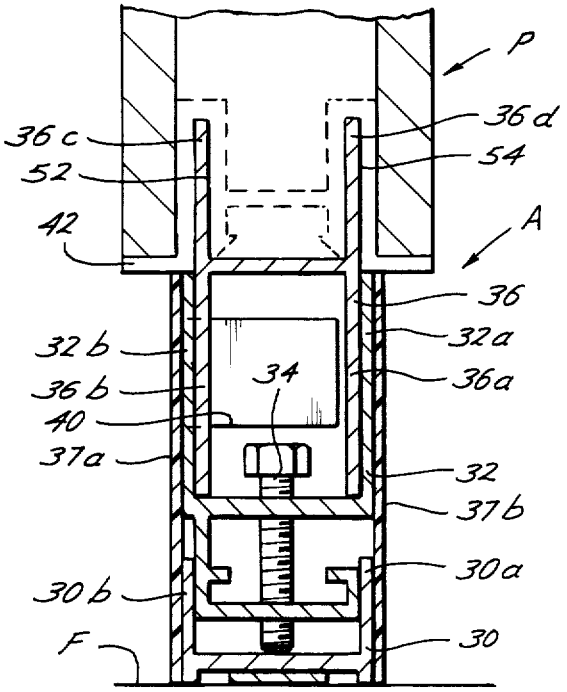
FIG. 2 is a side view, in section, of the lower portion of the modular wall panel unit apparatus of the present invention.

The reusable modular wall and ceiling construction of the present invention is generally designated A in FIGS. 1 and 2. Such construction A rests upon a substantially flat or horizontal building floor F while the modular ceiling construction, generally designated C in FIG. 1, is suspended by suitable means such as a chain or wire W from the floor or structure immediately above.

Such modular systems are based upon repeating a selected dimension, usually four or five feet (1.2 meters or 1.5 meters, respectively). The rod or striplike ceiling supports are disposed upon such dimensions and ceiling panels are normally supported upon such supports for providing a false ceiling that is normally disposed below the unsightly air ducting and electrical and communication wiring. Normally, the wall panel units also follow such modular dimension, but in some construction there is no correlation between the ceiling modular layout and the modular walls. In such instances, however, the wall panel units must be self-supporting as they are not connected with the ceiling grid unit.

As illustrated in FIG. 1, the ceiling grid is formed by a plurality of right angle intersecting elongated ceiling support members 10 which are preferably formed of extruded aluminum. The ceiling support member 10 is formed of a pair of spaced webs or flanges 10*a* and 10*b* that are mirror images of each other and which are connected or joined by spaced bracing portions (not illustrated). The wire W is attached to a hook 12 secured to a ceiling support attachment member 14 that is clipped or secured to the elongated ceiling support member 10. The flanges 10*a* and 10*b* are sufficiently flexible to enable lugs 14*a* and 14*b* of the support member 14 to releasably engage the elongated member 10 and are sufficiently flexible to enable their removal without damage to either the support member 14 or the elongated ceiling member 10 when it is desired to change the ceiling arrangement.

The elongated ceiling support member 10 is provided with ceiling panel attachment lugs 10*c* and 10*d* which are resiliently engaged by clips 16 and 18, respectively, which are secured to the enclosed ceiling panels 20 and 22, respectively. As the ceiling panels are laid out on the preselected modular distance, the panels 20 and 22 are usually square, but may be rectangular without departing from the scope of the invention. Screws 24 and 26 may be used to attach the clips 16 and 18 to the panels 20 and 22, respectively, but other means of attachment may be equally well suited for use. The ceiling panels 20 and 22 may be wrapped with a suitable fabric 20*a* and 22*a* to provide any desired visual appearance and for providing additional sound deadening insulation.

The lower portion of the modular wall panel construction including the wall panel support base is illustrated in FIG. 2. An extruded ground engaging member 30 has movably mounted thereon an upstanding carrier member 32. The carrier member 32 is provided with threads (not illustrated) engaging the threads of a helical bolt 34 in the usual manner in order that rotation of the bolt 34 relative to the carrier 32 will move the carrier 32 upwardly or downwardly relative to the ground engaging member 30 as is well known to those skilled in the art. Preferably, a plurality of such adjustment bolts 34 are carried on the elongated extruded carrier member 32 to relatively position it to the floor F and the ground engaging member 30 to ensure that the wall panel units are level and to compensate for variations in flatness or smoothness of the floor F. The upwardly extending lugs 30*a* and 30*b* of the ground engaging member 30 guide the vertical movement of the carrier member 32 in response to the rotation of the bolt 34.

The carrier member 32 is provided with upwardly projecting flanges 32*a* and 32*b* which also provide support for the wall panel unit P. Disposed between the upwardly projecting flanges 32*a* and 32*b* is an extruded H-shaped cross-section mounting member 36 which has downwardly extending flanges 36*a* and 36*b* which extend into the carrying member 32 for securing the mounting member 36 in position. The area between the downwardly projecting lugs 36*a* and 36*b* provides a tunnel or path for the running or installation of electrical and communication wires. In this regard a window 40 is formed in one of the plurality of stiffener sections of the carrier member 32 for each of installation. The mounting member 36 is provided with a pair of upwardly extending flanges 36*c* and 36*d* which are received within spaced recesses on the wall panel unit P as will be described in greater detail hereinafter for supporting the wall panel unit P. Decorative panels or strips 37*a* and 37*b* are secured to the carrier member 32 and floor engaging member 30 to provide a desired appearance after assembly. Such decorative strips may be economically discarded when revising the modular layout.

Figure 4:
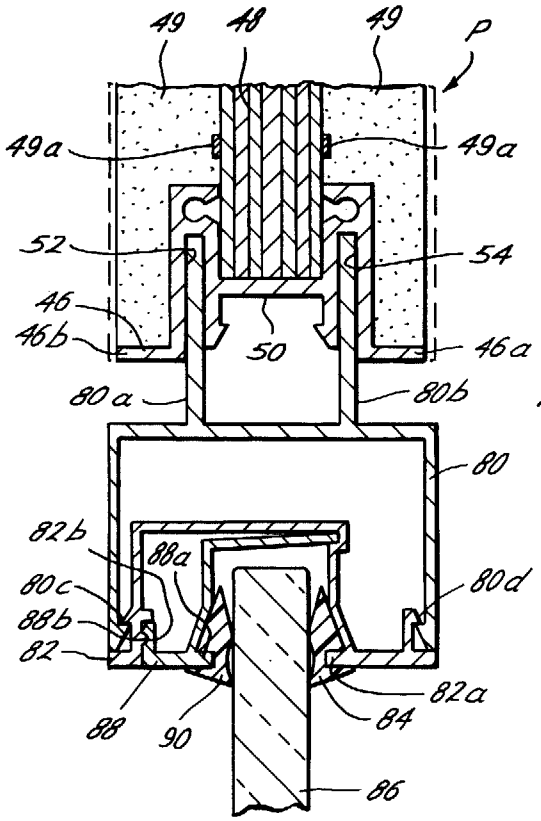
FIG. 4 is a top view, in section, illustrating the connection between the reusable modular wall panel unit apparatus of the present invention and a transparent panel modular wall unit.

The wall panel unit P of the present invention is partially shown in FIG. 2 where the lower substantially horizontal frame member 42 is illustrated with an upper substantially horizontal frame member also illustrated in cross-section in FIG. 1. As best illustrated in FIG. 4, the wall panel unit P is provided with a pair of opposed vertical side members 46 for forming a hollow metal rectangular support frame for the wall panel unit P. Disposed within the lower member 42, the upper member 44 and the side members 46 are a plurality of internal laminated support members 48. Each of the internal support members 48 serves as a support or stud having its lower end connected to the lower horizontal member 42 and the upper horizontal member 44 for providing rigidity and structural strength to the panel unit P. Insulating panel sheets 49 are disposed on both sides of the frame and held in position by the end flanges or support projections 46*a* and 46*b*. Corresponding support projections are formed on the upper member 44 and lower member 46. Suitable fabric, plastic or other covering material (illustrated in phantom) may be placed over the panel sheets 49 to provide an otherwise pleasing appearance.

The upstanding side members 46 and lower member 42 and upper member 44 are all provided with the same cross-section for supporting the panels 49 and providing the releasable interlocking connection with adjacent units P. The outer surface of each member defines a peripheral outer surface of the panel unit P. Due to the cross-section shape of the members, the outer peripheral surface is provided with a central recess 50 and a pair of slots 52 and 54 formed on either side of the central recess (FIG. 4).

As illustrated in FIG. 2 the recess 52 and 54 receive the upwardly standing projections 36*c* and 36*d*, respectively, of the mounting member 36 for mounting of wall panel unit P on the base 30. A similar attaching member 56 has downward projections 56*a* and 56*b* which are received within the slots on the peripheral surface formed by the upper horizontal member 44. The attaching member 56 extends upwardly through a slot formed in a ceiling C between ceiling panels 20 and 22 where it is received within an elongated slot 10*e* formed in the ceiling support member 10. The attaching member 56 fits snugly in the opening 10*e* adjacent to center panels 20 and 22 to provide an overall pleasing appearance and to maintain the upper portion of the wall panel unit P in vertical alignment. The slot 10e is provided with sufficient clearance to enable the member 56 to move further upwardly into the support member 10 when it is desired to disassemble the wall panel P from one location and move it to another.

Figure 3:
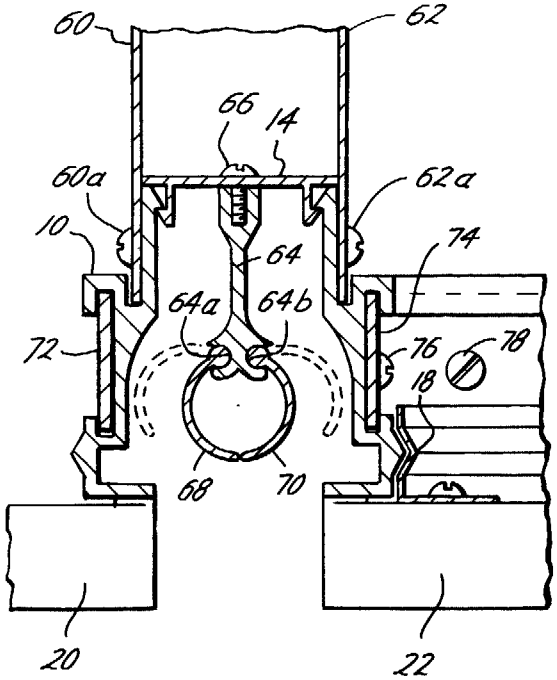
FIG. 3 is a side view, similar to FIG. 1, of another embodiment of the modular ceiling apparatus illustrating the air ducting arrangement of the present invention.

FIG. 3 illustrates in a cross-section view another embodiment of the elongated ceiling support member 10 having a multi-purpose function. The ceiling support member 10 is held in position by a pair of downwardly extending sheets 60 and 62 which are secured to the overhead structure by suitable means such as a wire (not illustrated). The members 60 and 62 are in turn attached to the ceiling support member 10 by screws 60a and 62a in the usual manner to provide an air ducting passage above the plate 14. The attachment plate 14 in this embodiment mounts an extruded alongated plastic base member 64 which is secured thereto by screws 66 in the usual manner. The elongated member 64 is provided with a pair of recesses 64a and 64b which receive therein moveable half circle extensions 68 and 70 which are movable from the position illustrated in FIG. 3 to that illustrated in phantom in the same figure. The molded plastic extensions 68 and 70 serve multiple purposes. For example, they may serve as the conduits for electrical and/or communication wires as well as ventilation ducting. The closed members 68 and 70 may serve as an air conditioning inlet duct and having a portion of the members 68 and 70 expanded to the phantom illustration for discharging the air conditioning through the slot between the ceiling pads 20 and 22.

The ceiling pads 20 and 22 are provided with the usual clips 18 for securing with the ceiling support member 10. In addition, clips 72 and 74 are shown at the intersection for maintaining the elongated members 10 at right angles to each other for maintaining the modular grid dimensions. The clip 74 is attached to the member 10 by the screw 76 while screw 78 is used for attaching the clip to the right angle intersecting the ceiling support member in the usual manner.

Referring now to FIG. 4, a wall panel adapter connector 80 is illustrated in cross-section. The slots 52 and 54 of the wall panel P receive mating projection 80a and 80b of the aluminum extruded panel adapter connector 80 for securing the panel unit P with the connector 80. Magnetic securing means for the panels 49 are provided by magnets 49a secured thereto which are attached to a metal tape secured to the internal support 48 for holding the panels 49 on the unit P. The adapter connector 80 is provided with a pair of locking shoulders 80c and 80d formed on the projections opposite the panel engaging projections 80a and 80b. Releasably secured to the shoulders 80c and 80d is a solid panel mounting member 82 which may be released by spreading the member 80 to enable the mounting member 82 to pass by the locking shoulders 80c and 80d. The panel mounting member 82 includes a gasket mounting flange 82a for mounting the gasket 84 which sealingly engages with a solid panel 86 which is preferably formed of transparent glass. A snap in panel keeper 88 carries a companion gasket 90 on a flange 88a for engaging the other side of the panel 86. The keeper 88 is sufficiently deformable within the mounting connector 82 to enable removal of the keeper 88 and the panel 86 when desired. A suitable recess 88b captures a lug 82b on the mounting member 82 to retain the keeper 88 in position.

Figure 5:
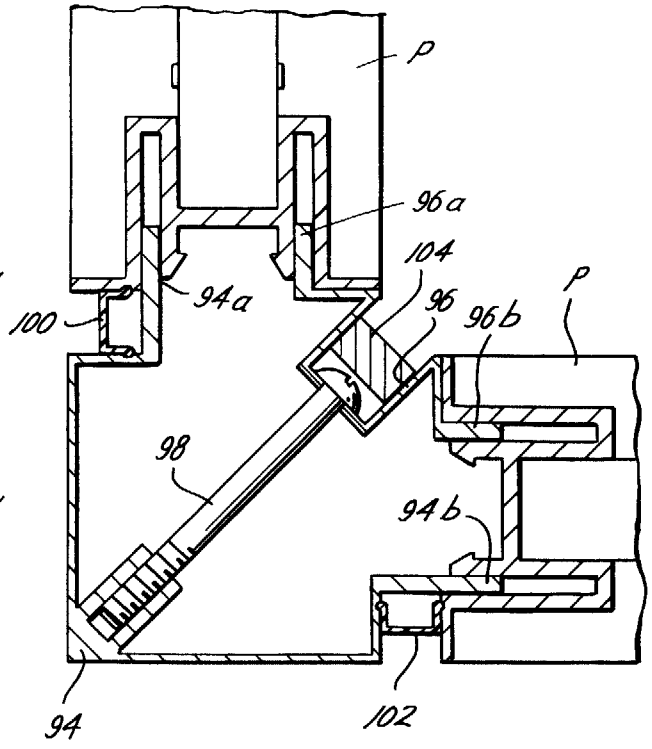
FIG. 5 is a top view, in section, illustrating a right angle connection of the modular wall panel unit apparatus of the present invention.

FIG. 5 is a cross-sectional view of the vertical right angle wall connector for the panel units P. The connector, generally designated 92, comprises an outer member 94 to which inner member 96 is secured by bolting 98 in the usual manner. The member 94 has panel slot engaging portions 94a and 94b which engage slots of the panels on the same sides of the central recess 50. The member 96 also has panel slot engaging portions 96a and 96b for engaging the other slot on the periphery of the panels P. When secured in the manner illustrated, a self-supporting connection is made for the wall panel P. Suitable disposable resilient plastic strips 100 and 102 are used to fill the space between the connector member 94 and the panel units P. A similar resilient plastic strip 104 is used to hide the bolt head 98 when installed on the connector member 96. Such strips are illustrated with respect to FIG. 5, but it is understood that they may be used with the other connections.

Figure 7:
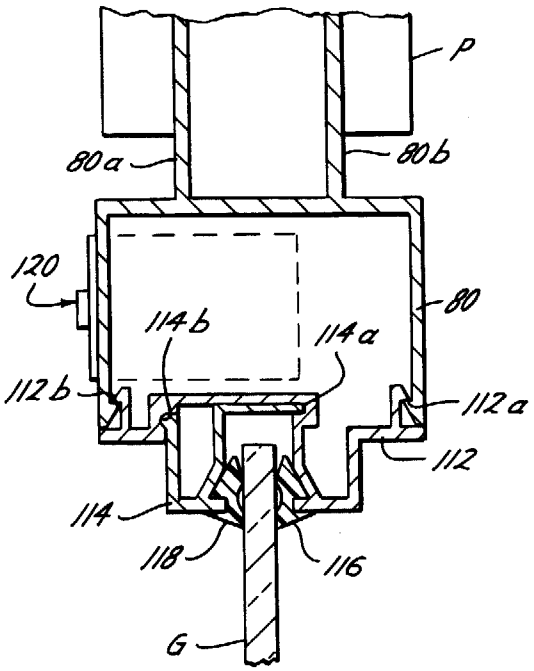
FIG. 7 is a top view, in section, illustrating the mounting of the vertical side edge of the thin transparent panel member with the modular wall panel unit apparatus.
Figure 6:
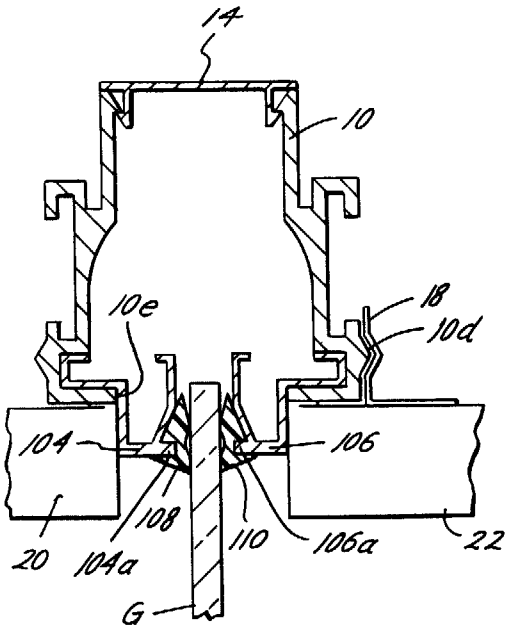
FIG. 6 is a side view, in section, illustrating the top or ceiling connection of a thin transparent modular panel.

FIGS. 6 and 7 illustrate side and top views, respectively, of an embodiment of the present invention for mounting of a thin panel, usually made of glass in the modular system. As illustrated in FIG. 6, the elongated ceiling support member 10 and attachment member 14 are similar to that illustrated in FIG. 1. Releasably secured in slots formed by ceiling support member 10 within the opening 10e of the ceiling support member 10 are a pair of extruded aluminum inserts 104 and 106 which are mirror images of each other. The opposed members 104 and 106 have gasket carrying flanges 104a and 106a for mounting panel engaging flexible strips or gaskets 108 and 106 which supportingly engage on opposite sides of the thin panel G which, as previously mentioned, is usually glass, and which may be of varying degrees of transparency, translucent or opaque. The side mounting of the glass panels G is illustrated in FIG. 7 where the vertical extruded multi-purpose housing 80 has the connecting projections 80a and 80b extending into the openings of the panel unit P in a manner previously described. Releasably secured to the vertical housing 80 is the thin panel keeper frame 112 which is secured to the housing 80 by lug engagements 112a and 112b. Secured to the mounting frame 112 is a releasable keeper 114 which is held in engagement with the frame at 114a and 114b by a resiliently deformable snap-in arrangement. A gasket 116 is carried by the fixed frame member 112 while the keeper carries another gasket 118. When the keeper 114 is snapped into position, the gaskets 116 and 118 grip the glass panel G on opposite sides for securing it in position. The hollow housing 80 may be used as a runway for electrical and/or communication wiring with an electrical power switch being indicated at 120.

Figure 8:
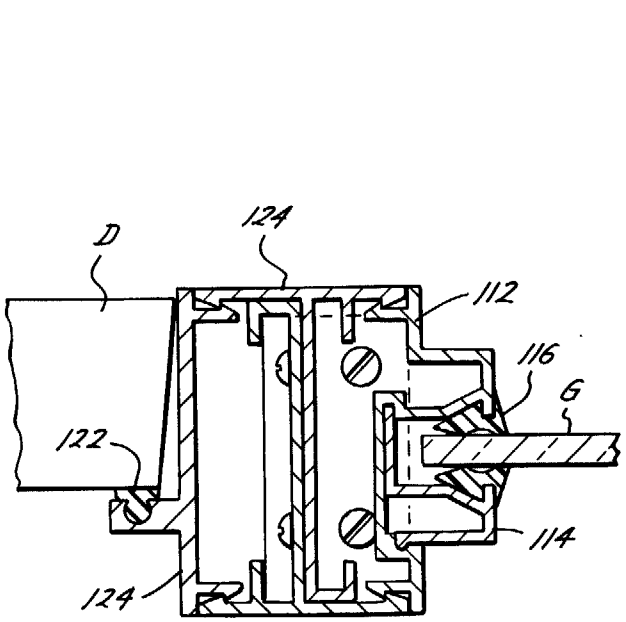
FIG. 8 is a vertical cross-section of the modular wall panel unit apparatus providing a door jamb for connection wih the side edge of the thin transparent panel member.

FIG. 8 represents the capability of the side connection of FIG. 7 to interadapt with a door jamb. The door D is pivotally mounted to swing away from the door jamb but when in the closed position illustrated, engages the pad 122 secured on the door jamb. The vertical housing 124 has snapped or attached on one side the thin panel G mounting system illustrated in FIG. 7 being the frame 112 and keeper 114. On the other side is releasably secured the door stop mounting member 124 which mounts the resilient stop 122. Like the frame member 114, the member 124 merely snaps into the vertical housing 124 and may be released by the use of a screwdriver and sufficiently deforming of the housing member 124 to enable the lugs to come out of engagement.

Figure 9:
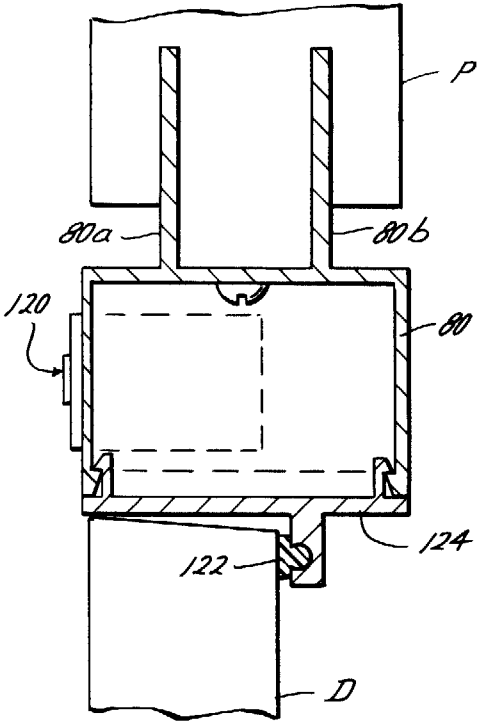
FIG. 9 is a view similar to FIG. 8 illustrating a door jamb mounted with the modular wall panel unit apparatus of the present invention.

FIG. 9 is a cross-sectional view of the vertical multipurpose housing member 80 having the panel securing projections 80*a* and 80*b*. Snapped into the opening of the housing member 80 is the door stop mounting member 124 carrying the door engaging stop 122. A light switch 120 may also be positioned within the housing member 80.

Figure 10:
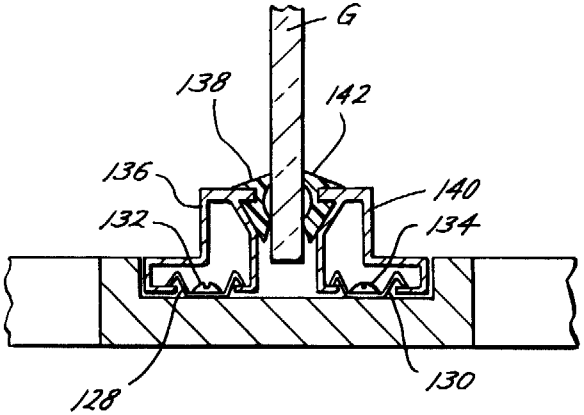
FIG. 10 is a top view, in section, of a thin transparent member secured at right angles to the modular wall panel unit apparatus.

FIG. 10 illustrates the side mounting of the thin panel G at a right angle relationship to another panel. The panel is provided with a recess 126 in which clips 128 and 130 are secured by suitable means such as wood screws 132 and 134. Attached to the clip 128 is a panel holder 136 which carries a gasket 138 for engaging the glass panel G. A holder 138 is also attached to the clip 130 for carrying the gasket 132 to engage the glass panel G opposite the gasket 138 and to cooperate to hold the panel G in position. The holders 136 may be released from the clip 128 by the use of a screwdriver or the like for promoting the reuse of the system. The spring clips 128 and 130 have sufficient strength to maintain the panel holders 136 and 140 in the illustrated position.

Figure 11:
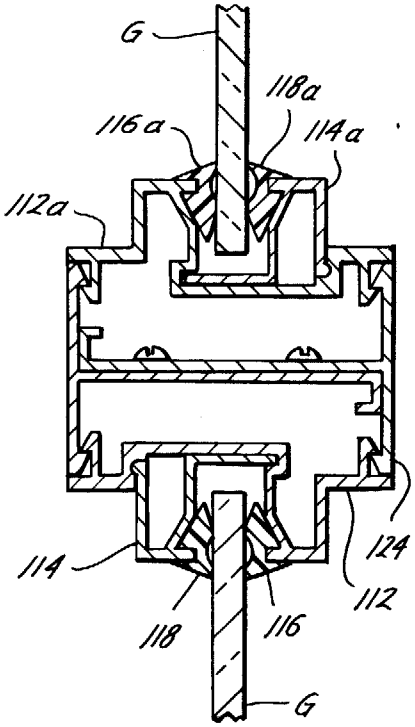
FIG. 11 is a vertical view, in section, illustrating the modular connection of a pair of thin transparent panel members by the modular wall apparatus.

FIG. 11 illustrates a connection between two thin wall glass panes in accordance with the present invention. The vertical housing 124 is similar to that illustrated in FIG. 8 but instead of a door jamb support 124, another panel mounting frame 112*a* and keeper 114*a* are illustrated. The support frame 112 and keeper 114 are also similar to those illustrated in FIGS. 7 and 8.

Figure 12:
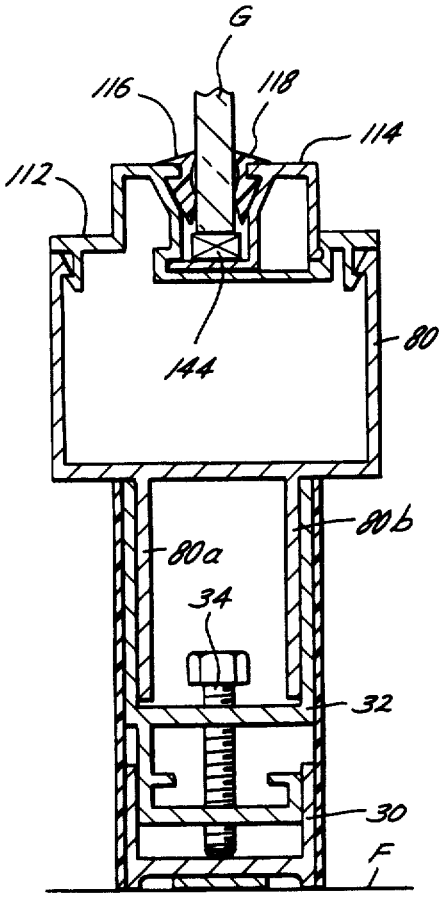
FIG. 12 is a side view, in section, of a base assembly supporting a thin transparent panel member.

FIG. 12 illustrates the base support for the thin panel G unit. As is illustrated in FIG. 1, the base 30 and 32 provides an adjustable means for mounting the wall panel units. Carried on the movable member 32, however, is the extruded frame 80 with the usual panel slot engaging members 80*a* and 80*b* secured within the support member 32. Secured to the other end of the member 80 in the panel retaining frame 112 and the snap in keeper 114. When used in this embodiment, the frame 112 and keeper 114 serve as support for the panel and to this end a cushioned gasket 144 is provided for suspending the panel G above the portion of the keeper 114.

Figure 13:
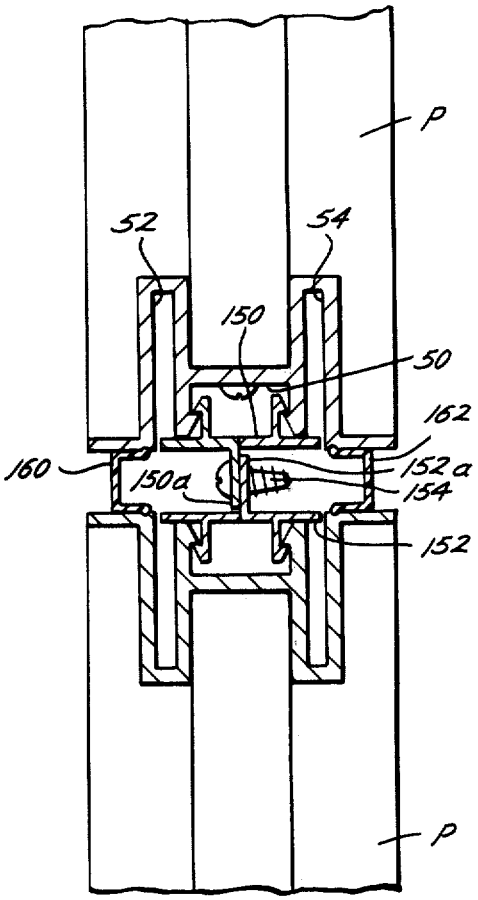
FIG. 13 is a vertical view, in section, illustrating the side connection of the modular wall panel unit apparatus of the present invention.

FIG. 13 illustrates another embodiment for connecting wall panel units P. In this embodiment, an insert 150 is snapped into the central cavity 50 of the panel unit P while a similar insert 152 is used on the adjacent panel unit P. Each of the inserts 150 and 152 is provided with an outwardly extending flange 150*a* and 152*a* having a plurality of line openings for receiving attachment screws 152 in the usual manner. Strips of deformable resilient plastic 160 and 162 may then be installed to fill the gap and provide the desired suitable pleasing appearance.

As with any modular system, the modular system of the present invention should be planned to the appropriate dimensions using either the wall panel units P or the thin panel units G as well as the necessary or desirable doors D and the like. Initially it is preferable that the elongated ceiling grid members 10 be installed below the ducting and the suitable electrical connections run. However, at this point it may be desirable to only partially install the wiring and wait until the wall panel units and the vertical attachment members such as the housing 80 are installed. This of course will depend upon each particular installation. With the ceiling grid members 10 installed, it may be desirable then to lay the various base members for the wall panel units. With these units installed and adjusted, the various panel units may then be installed in the manner illustrated. This is done by elevating the panels up into the slot 10*e* and letting the panels slide down within the carrier member 32 of the support base. When it is desired to disassemble the wall panel units it is only necessary to elevate the panel units sufficiently to remove the connector with the lower base in order that the panel may be moved out of position. Such disassembly does not damage the wall panel units P or G and enables their reuse when the modular system is arranged in another desirable layout pattern.

The foregoing disclosure and description of the invention are illustrative and explanatory thereof, and various changes in the size, shape and materials as well as in the details of the illustrated construction may be made without departing from the spirit of the invention.

I claim:

1. A reusable modular wall panel unit apparatus adapted to connect to adjacent modular wall panel units to form an interior wall, including:

a hollow rectangular metal frame having a horizontal bottom frame member and a pair of upstanding vertical side members, one of said upstanding side members connected to one end of said bottom frame member and the other of said upstanding side members to the other end of said bottom frame member, said frame having a horizontal upper frame member connected at one end to one of said upstanding members and with the other end of said upper member connected to the other of said upstanding members;

said bottom member and said top member along with said upstanding side members defining an outer peripheral rim of the modular wall panel unit;

a plurality of internal support members disposed in parallel relationship with said upstanding side members, each of said plurality of internal support members having one end connected to said bottom member and the other end connected to said top member;

support projections mounted on said bottom, top and two upstanding members and extending outwardly on both sides of said peripheral edge for providing a support for a panel disposed on each side of said metal frame; and said peripheral rim having a central recess and having a first slot formed parallel to and on a first side of said central recess and a second slot formed parallel to and on the other side of said central recess;

support means for said metal frame having a floor engaging member and a mounting member having a pair of upwardly extending parallel projections that are received within said slots on said bottom frame member, said support means having means for connecting said floor engaging member and said mounting member to adjustably position said wall panel unit relative to the floor; and means for releasably connecting said horizontal upper frame member with a modular suspended ceiling for supporting said modular wall panel unit apparatus perpendicular to the floor.

2. The apparatus as set forth in claim 1, wherein said means for releasably connecting includes:

an elongated connector having a pair of webs adapted to be received partially within said first and said second slot of said portion of said peripheral rim formed by said horizontal upper frame member, said webs extending upwardly from peripheral rim for attaching to said ceiling.

3. The apparatus as set forth in claim 1, wherein:

said means for connecting said floor engaging member and said mounting member including a helical screw and a screw engaging member, said screw engaging member adjustable on said helical screw for positioning said wall panel unit relative to the floor.

4. The apparatus as set forth in claim 3, wherein:

said means for connecting said floor engaging member and said mounting member including a second helical screw and a second screw engaging member, said second screw engaging member adjustable on said second helical screw for cooperating with said first mentioned helical screw and screw engaging member for positioning said wall panel unit relative to the floor.

5. The apparatus as set forth in claim 1, including:

magnetic means for holding said panels on said frame of said apparatus.

* * * * *